US005547021A

United States Patent [19]

Raden

[11] Patent Number: 5,547,021

[45] Date of Patent: Aug. 20, 1996

[54] METHOD AND APPARATUS FOR FLUID PRODUCTION FROM A WELLBORE

[76] Inventor: Dennis P. Raden, P.O. Box 101, McNeil, Tex. 78651

[21] Appl. No.: 433,210

[22] Filed: May 2, 1995

[51] Int. Cl.[6] ..... E21B 34/06; E21B 43/40; E21B 47/06

[52] U.S. Cl. ..... 166/250.07; 166/242.1; 166/267; 166/370; 166/371; 166/372

[58] Field of Search ..... 166/53, 250.07, 166/250.15, 242.1, 267, 310, 370, 371, 372

[56] References Cited

U.S. PATENT DOCUMENTS

| | | | |
|---|---|---|---|
| 1,028,822 | 6/1912 | Honey | 166/372 X |
| 1,547,197 | 7/1925 | Arbon . | |
| 1,602,190 | 10/1926 | Eddy et al. . | |
| 1,798,774 | 3/1931 | Yates . | |
| 1,856,872 | 5/1932 | Kogan . | |
| 2,588,296 | 3/1952 | Russell, Jr. . | |
| 3,215,087 | 11/1965 | McLeod, Jr. | 166/372 |
| 4,345,647 | 8/1982 | Carmichael | 166/66 |
| 4,347,899 | 9/1992 | Weeter | 166/371 X |
| 4,390,061 | 6/1983 | Short | 166/53 |
| 4,509,599 | 4/1985 | Chenoweth et al. | 166/370 |
| 4,688,637 | 8/1987 | Theis | 166/370 X |
| 4,844,156 | 7/1989 | Hesh | 166/263 |
| 5,076,360 | 12/1991 | Morrow | 166/370 X |
| 5,400,858 | 3/1995 | Blanchard et al. | 166/370 |

FOREIGN PATENT DOCUMENTS 883369 11/1981 U.S.S.R. .

*Primary Examiner*—George A. Suchfield
*Attorney, Agent, or Firm*—Stephen R. Greiner

[57] ABSTRACT

A method and apparatus for producing a well by varying its downhole pressure. A vacuum is applied to the top of a single string of tubing in a cased wellbore to encourage the formation of free gas at the bottom of the tubing string. The resulting free gas entrains reservoir liquids proximate the inlet opening in the tubing bottom and reduces the pressure gradient in the tubing thus maximizing fluid flow rates to the surface. To further enhance production rates in the event that reservoir gas/oil ratios are too low, supplemental gas volumes may be delivered to the well casing/tubing annulus.

14 Claims, 1 Drawing Sheet

METHOD AND APPARATUS FOR FLUID PRODUCTION FROM A WELLBORE

FIELD OF THE INVENTION

The present invention relates generally to methods and apparatus for producing a well by varying its downhole pressure.

BACKGROUND OF THE INVENTION

Natural sources of pressure are typically utilized in the primary production of fluids from an oil reservoir. As a practical matter, pressure derived from: the evolution of dissolved gas from oil, gas cap expansion, and water encroachment comprise the three principal reservoir drive mechanisms. To a lesser extent, liquid expansion, reservoir compaction, and gravity also play a role in the production of hydrocarbon fluids. As a practical matter, however, most reservoirs produce fluids through some combination of each mechanism.

As is well known, at some time during the producing life of an oil reservoir, its internal pressure may be reduced to the point where supplemental energy is required to maintain production rates at economic levels. In the usual case, measured volumes of gas or water are delivered to the partially depleted reservoir through one or more wellbores provided for this purpose to increase the internal pressure of the reservoir as well as its productive life. This process commonly referred to as secondary recovery.

On average, primary and secondary recovery processes produce no more than approximately one-third of the "oil originally in place" (OOIP) in a given oil reservoir. To recover the remaining OOIP, various enhanced recovery techniques have been proposed. With the exception of steam flooding and in situ combustion, with their attendant pollution related drawbacks, most enhanced recovery techniques involve the injection of one or more chemical compositions into a targeted reservoir. Due to the relatively high costs associated with preparing and handling these chemical compositions, however, enhanced recovery projects will account for little oil recovery in the United States during the foreseeable future.

At the present time, nearly eighty percent of our domestic oil wells produce less than ten barrels of oil per day. This low rate of oil production is often due, in part, to the accumulation of oil bearing liquid in the well which imposes an additional backpressure on a pressure depleted reservoir further impeding liquid flow therein. In some wells, this liquid accumulation may altogether halt the further production of oil thus necessitating well abandonment. As the installation and operation of mechanical pumps to lift oil bearing liquid from a well is costly, a significant need exists, therefore, for an economical means for increasing oil recovery from marginally productive wells.

SUMMARY OF THE INVENTION

In light of the foregoing need, it is a principal object of the invention to provide an apparatus for fluid production from an oil bearing reservoir in the earth. In its preferred form, the apparatus includes a perforated, tubular well casing extending into the earth and defining a sump therein for collecting oil bearing liquid. A string of tubing in the well casing includes an inlet opening positioned in the sump. A plurality of downwardly projecting fins positioned about the inlet opening define notches therebetween serving to improve the entrainment of oil bearing liquid collected in the sump into the available free gas as such enters the inlet opening. Vacuum producing means are also provided to impose a vacuum on the oil bearing liquid collected in the sump and assist in drawing the oil bearing liquid into the inlet opening.

It is another object of the invention to provide an apparatus of the type described wherein the vacuum producing means include a vacuum pump which may be supplemented in its action by at least one gas ejector in serial communication therewith. Preferably, the vacuum pump outlet is in fluid communication with the well casing so as to supply pressurized gas to the well casing for impelling oil bearing liquid collected in the sump to the inlet opening in the string of tubing. A secondary source of pressurized gas may also be placed in fluid communication with the well casing for impelling oil bearing liquid to the inlet opening.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawing.

BRIEF DESCRIPTION OF THE DRAWING

The present invention may be more readily described with reference to the accompanying drawing, in which.

DETAILED DESCRIPTION OF THE PREFERRED EMBODIMENT

Figure 1:
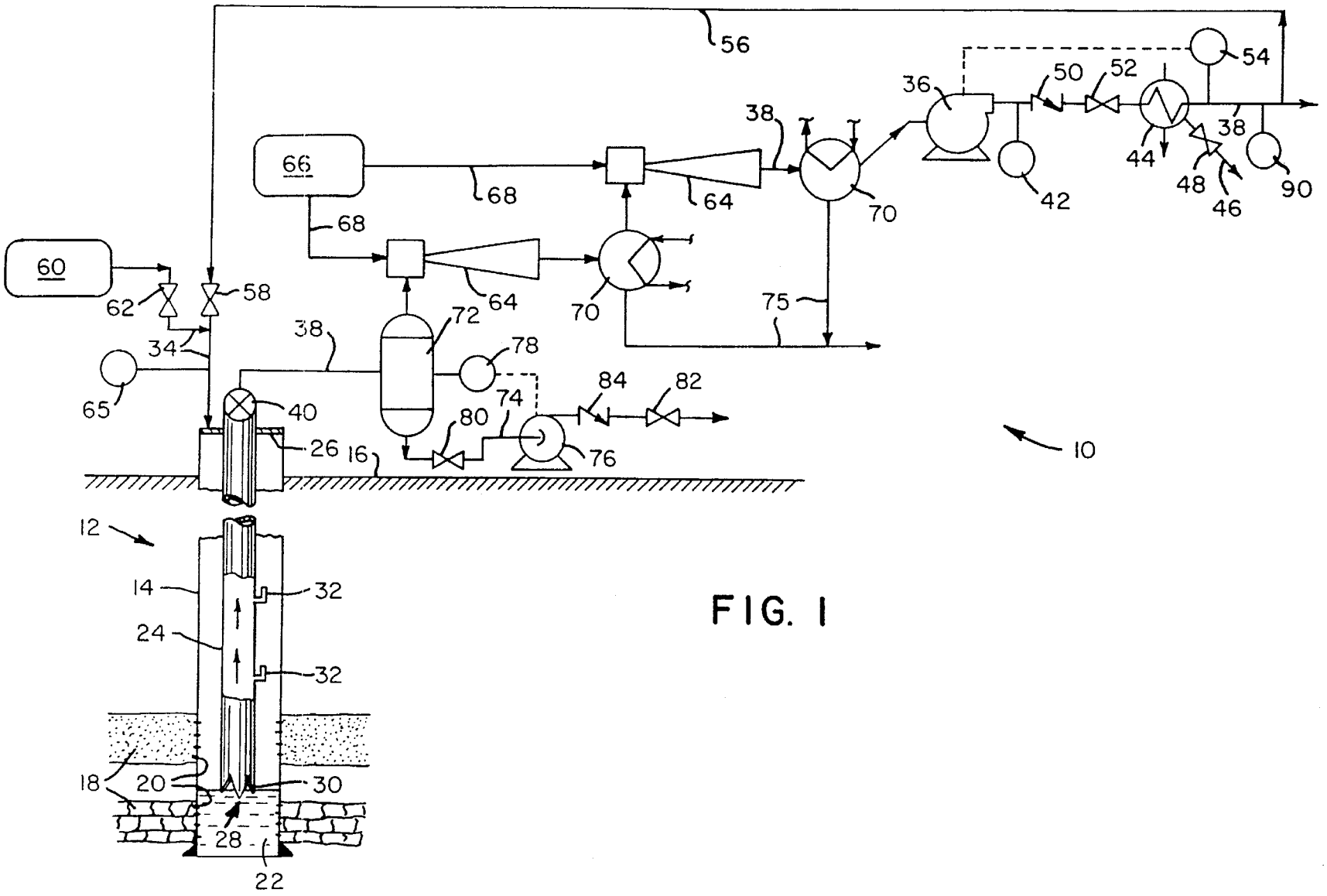
FIG. 1 is a schematic diagram showing an apparatus for fluid production from a wellbore in accordance with the present invention.

Referring now to FIG. 1, an apparatus for fluid production from a wellbore in accordance with the present invention is illustrated schematically at 10. The apparatus 10 includes an oil well 12 of conventional construction modified as needed to practice the invention. The oil well 12, then, is preferably provided with a tubular well casing 14 positioned in a borehole in the earth extending from the ground surface 16 to a point at a prescribed distance below the top one or more oil bearing reservoirs 18. Perforations 20 in the well casing 14 adjacent the oil bearing reservoirs 18 permit reservoir fluids to enter the well casing 14. Under the influence of gravity, oil bearing liquid will accumulate in the sump 22 formed in the lower end of the well casing 14. A string of tubing 24 is suspended within the well casing 14 from a sealed wellhead 26 on the upper end of the well casing 14 and extends from the ground surface 16 into the sump 22.

The bottom of the tubing 24 defines an inlet opening 28 for the receipt of oil bearing liquid from the sump 22. About the inlet opening 28, a plurality of projections or fins 30 extend from the tubing 24 to a point partially beneath the liquid level of the sump 22. Preferably, the fins 30 are integrally formed with the tubing 24, or any other tubular body adapted for connection to the tubing, and define a plurality of secondary openings or notches therebetween. The notches serve to increase free gas velocities at the inlet opening 28 by effectively reducing the cross-sectional area available for gas flow above the sump liquid level. The fins 30 may be shaped in a variety of forms to provide notches having a generally rectangular or circular outline; however, a V-shape is preferred due to its relative ease of manufacture. The notches may be provided in any number and any size found to maximize the oil bearing liquid production rate from oil well 12.

The internal diameter of tubing 24 may be varied to maximize the oil bearing liquid production characteristics of the oil well 12. As the flow of oil bearing liquid through tubing 24 in the form of either an annular film or a mist suspended in a stream of gas is contemplated by the instant invention, the internal diameter of tubing 24 is preferably sized to minimize inefficient, slug-type flow. In this regard, tests of high gas/oil ratio (generally less than 5% by volume liquid) wells indicate that oil bearing liquid will migrate through tubing 24 in the form of annular film at a velocity of approximately 2 ft/sec when gas velocities exceed approximately 30 ft/sec. On the other hand, mist-type flow, where oil bearing liquid is transported as fine droplets suspended in gas, will occur only when gas velocities exceed approximately 70 ft/sec. Thus, it is preferable that the internal diameter of the tubing 24 be sized in view of gas volumes available for lifting purposes to establish and maintain a gas velocity of 30 ft/sec or greater to avoid slug-type flow.

In the preferred embodiment, a plurality of gas lift valves 32 are positioned on the tubing 24 to assist in the start-up of the apparatus 10 by rapidly removing from the oil well 12 oil bearing liquid, accumulated in the oil well 12 as a result of a shut-down, submerging the inlet opening 28 of tubing 24. During start-up, relatively high pressure gas is delivered to the well casing 14 through a conduit 34 in fluid communication with wellhead 26 to permit sequential actuation of the gas lift valves 32 in well known fashion and lower the oil bearing liquid level in the well casing 14 to a point below the inlet opening 28. In accordance with accepted engineering practices, the number and spacing of gas lift valves 32 would be determined on a well by well basis.

As an alternative to utilizing conventional gas lift valves 32 for unloading the oil well 12 at start-up, electrically or pneumatically actuated valves may be substituted therefor. In an electrically actuated system, suitable relays (not shown) would open and close the valves upon selective energization by electrical current delivered through an insulated lead or cable (not shown) positioned within the well casing 14. With a pneumatically actuated system, however, a pressurized pneumatic conduit (not shown) would be positioned in the well casing 14 to communicate with, and control, each of the valves, operable at a predetermined pressures.

Conventional means for imposing a vacuum such as vacuum pump 36, having a pump inlet connected through a conduit 38 communicating with the inside of the tubing 14, is provided to impose a vacuum on the oil bearing liquid collected in the sump 22. The vacuum serves to draw oil bearing liquid collected in the sump 22 into the inlet opening 28 and up the tubing 24 for recovery via the wellhead 26 and increases the rate at which oil bearing liquid enters the well casing 14 through perforations 20. Preferably, the amount of vacuum imposed by vacuum pump 36 upon the tubing 24 is selectively adjusted by a valve 40 in the conduit 38 to retain intake opening 28 partially submerged in oil bearing liquid collected in sump 22.

The vacuum pump 36 compresses the gas transported through the conduit 38 to the desired degree and delivers such from its pump outlet past pressure gauge 42 to a condenser 44. Preferably using circulating water as a cooling agent, the condenser 44 operates to remove liquid hydrocarbons and water vapor from the gas stream prior to discharge into a sales line or other suitable carrier. Condensed liquid is discharged from the condenser 44 into a conduit 46 for further processing and storage. A valve 48 of any suitable construction is provided on the conduit 46 for draining the condenser 44 either automatically or manually of condensed liquid as may be desired. Additional valves 50 and 52 are provided on the conduit 38 to, respectively, check the backflow of fluids into the vacuum pump 36 and to isolate the vacuum pump 36 from the condenser 44 when required for maintenance. A temperature gauge 90 is also provided in conduit 38 for monitoring the operation of apparatus 10 and assisting in determining when maintenance may be required.

An oxygen analyzer 54 in the conduit 38 downstream of the condenser 44 is provided to monitor the fraction of oxygen in the gas flow stream. If the oxygen fraction exceeds a prescribed level, perhaps one proximate that at which an explosive mixture is constituted, the analyzer 54 will preferably function to disable the vacuum pump 36 from continued operation. Once the source of the oxygen has been located and its continued flow into the apparatus 10 abated, the vacuum pump 36 may be returned to operation by a user. Thus, the safety of users of the instant invention is ensured by permitting system leaks upstream of the oxygen analyzer 54 to be detected and repaired prior to the creation of a potentially hazardous operating condition.

A portion of the compressed gas exiting the condenser 44 is carried through a conduit 56, having a valve 58 at its terminal end in communication with conduit 34, into the well casing 14 to assist in impelling oil bearing liquid collected in the sump 22 to the inlet opening 28 in tubing 24. Supplemental gas volumes for this purpose may also be provided to the well casing 14 from a remote gas source 60 otherwise used in operative conjunction with gas lift valves 32. As shown, the remote gas source 60, comprising natural gas, nitrogen, or any other suitable gaseous composition under pressure, is connected by conduit 34 to well casing 14 through wellhead 26. A valve 62 is provided in the conduit 34 to control the rate of gas flow from the remote gas source 60. A pressure gauge 65 is provided in the conduit 34 for monitoring the pressure of gas passing therethrough.

A conventional liquid metering device (not shown) may be placed in fluid communication with the conduit 34 for delivering a relatively small flow of liquid chemical composition to the well casing 14 on an intermittent or continuous basis. In well known fashion, such a liquid chemical composition would enter the well casing 14 near the top thereof and travel within the well casing to mix with the oil bearing liquid in the sump 22. By way of example only, the liquid chemical composition may include scale or corrosion inhibitors, de-emulsifying agents, and solvents for the reduction of oil bearing liquid viscosities prolonging the productive life of oil well 12. To provide additional energy to lift reservoir fluids up the tubing 24, a pair of conventional jets or gas ejectors 64 are preferably serially connected to the conduit 38 between the tubing 24 and vacuum pump 36. The ejectors 64 increase the vacuum imposed upon the tubing 24 by delivering a high velocity stream of gas from a suitable source 66 to the conduit 38, or other appropriate fitting in fluid communication therewith, that is directed substantially downstream toward vacuum pump 36. The velocity of the gas emitted by the ejectors 64 may be regulated by suitable valves (not shown) in gas delivery conduits 68 or any other means. By way of example, the gas source 66 may be a steam boiler, an air compressor, or a tank of pressurized natural gas. As steam is the preferred motivating gas for use in the ejectors 64, however, condensers 70 of well known construction are provided downstream of each ejector 64 to remove suspended water vapor from the gas stream by circulating a cooling liquid therethrough. Condensed liquids are discharged from the condensers 70 through conduits 75 for additional processing.

A liquid-gas separator 72 is preferably employed in the conduit 38 upstream of the ejectors 64 and vacuum pump 36 for an initial separation of oil bearing liquid and gas delivered from tubing 24. Separated gas is discharged from separator 72 into the downstream continuation of conduit 38 which leads to the vacuum producing means as described hereinabove. Separated oil bearing liquid, on the other hand, is discharged from the separator 72 into a conduit 74 for further processing and storage.

A conventional liquid pump 76 is provided to assist in the transport of oil bearing liquid through the conduit 74. As shown, operation of the liquid pump 76 is preferably regulated by an electrical switch 78 responsive to oil bearing liquid level variations in the separator 72. When the oil bearing liquid level in the separator 72 rises to a designated height, the liquid pump 76 is actuated to remove the surplus oil bearing liquid from the separator 72. Valves 80 and 82 in conduit 74 on opposite sides of the liquid pump 76 permit the pump 76 to be isolated from the remainder of apparatus 10 in the event that repairs are required. A check valve 84 downstream of the liquid pump 76 prevents the reentry of discharged oil bearing liquid into the separator 72.

During use of the apparatus 10, the oil bearing liquid level in the well casing 14 is first lowered to a point partially submerging inlet opening 28 and fins 30 in tubing 24 by operation of gas lift valves 32 as hereinabove described. Production proper begins by evacuating gas from the tubing 24. Through operation of the vacuum pump 36 and ejectors 64, evacuation of gas from the tubing 24 proceeds in an effort to establish a vacuum generally limited only by the vapor pressure of the liquid or the collapse strength of the tubing 24 and well casing 14. The reduced pressure in the tubing 24 is communicated via the perforations 20 to the oil bearing reservoirs 18 and may be effective in drawing reservoir fluids thereto.

Continued application of the vacuum encourages the evolution of free gas from oil bearing liquid collected in the sump 22. When the reservoir gas/oil ratio permits, this free gas will enter the inlet opening 28 in the tubing 24 at a high velocity, atomizing the oil bearing liquid in the sump 22 proximate the inlet opening 28 and entraining such in the free gas flow stream. With the hydrostatic pressure in the tubing 24 reduced substantially by the presence of the free gas, oil bearing liquid flow rates up the tubing 24 are correspondingly increased.

In the event that the volumes of gas evolved from the oil bearing liquid in the sump 22 are insufficient to lift the oil bearing liquid up tubing 24, supplemental gas volumes may be delivered to the well casing 14 from remote gas source 60 preferably at such a rate so as to permit annular or mist-type flow of oil bearing liquid up the tubing 24. For maximum efficiency, in no event, however, should the supply of supplemental gas be so great as to reduce the depth of oil bearing liquid maintained in the sump 22 to a point wherein the intake opening 28 of the tubing 24 is not partially submerged. Along with the supplemental gas volumes from remote gas source 60, liquid chemical compositions may also be provided to the well casing 14 as desired.

As discussed hereinabove, the notches between the fins 30 adjacent inlet opening 28 form zones capable of generating gas flow streams of high velocity and turbulence for the atomization and entrainment of oil bearing liquid therein. Additionally, the flow of gas at high velocity through these notches is believed to cause oil bearing liquid in the sump 22 to bulge or cone upwardly into the inlet opening 28. This upwardly directed bulge maximizes the area of contact between the oil bearing liquid in the sump 22 and turbulent gas thereby contributing to the increased atomization and entrainment of oil bearing liquid into the gas. Since it is desired to have the bulge in the oil bearing liquid surface to occur in the center of the inlet opening 28 for the maximum flow of gas past the bulge, the fins 30 and their medial notches are preferably evenly spaced around the periphery of the tubing 24 and inlet opening 28.

In a preferred operating regime of apparatus 10, the fluid moving through tubing 24 under the influence of the vacuum imposing means is substantially all gas with oil bearing liquid forming a mist suspended therein. In such an environment, compounds of relatively low molecular weight and boiling point comprising the fine droplets of mist may enter the gas phase. Such a phase transition may be advantageous, for instance, when solvents such as LPG, gasoline, or alcohol are provided to the well casing 14 for reducing oil bearing liquid viscosities in an effort to increase flow up the tubing 24. Solvents suspended along with heavier hydrocarbons in the mist droplets would readily enter the gas phase upon the reduction of pressure in the tubing 24. Solvent recovery could be made by condensation downstream of vacuum pump 36 in condenser 44.

Of course, produced fluids exiting the tubing 24 enter the separator 72. Gas exiting the separator 72 is substantially free of most oil bearing liquid suspended therein and flows toward the ejectors 64 and vacuum pump 36. The gas discharged from the vacuum pump 36 is preferably cooled in condenser 44 to recover hydrocarbon compounds having a relatively low boiling point. The resulting dry gas from the condenser 44 may be sold, recycled to the oil bearing reservoirs 18 through one or more separate injection wells (not shown) for pressure maintenance purposes, directed back into the well casing 14 through conduit 56 for fluid lift purposes, or flared.

While the invention has been described with a high degree of particularity, it will be appreciated by those skilled in the art that numerous modifications and substitutions may be made thereto. For example, the number and location of the ejectors 64 and their associated condensers 70 may be varied in accordance with user need, known to vary from well to well. Additionally, with little modification, the invention may be adapted for use in horizontal and highly deviated wells and in the production of liquids from coalbed methane and natural gas wells. Therefore, it is to be understood that the present invention is not limited to the sole embodiment described above, but encompasses any and all embodiments within the scope of the following claims.

I claim:

1. An apparatus for fluid production from an oil bearing reservoir in the earth, comprising:

a tubular well casing extending into the earth, said well casing including a lower end disposed below the top of the oil bearing reservoir and an upper end remote therefrom, said well casing including a plurality of perforations therethrough communicating with the oil bearing reservoir so that liquid flows into said well casing through said plurality of perforations, said well casing defining a sump therein at said lower end of said well casing for collecting oil bearing liquid therein;

a sealed wellhead on said upper end of said well casing;

a string of tubing depending from said wellhead in said well casing, said string of tubing including a lower end defining an inlet opening positioned in said sump, said string of tubing further including a plurality of downwardly projecting fins about said inlet opening; and, a vacuum pump having a pump inlet and a pump outlet, said pump inlet communicating with the inside of said string of tubing so as to impose a vacuum on the oil bearing liquid collected in said sump and assist in drawing the oil bearing liquid collected in said sump into said inlet opening.

2. The apparatus according to claim 1 further comprising at least one gas ejector in serial communication with said vacuum pump for increasing the vacuum imposed through said string of tubing on the oil bearing liquid collected in said sump.

3. The apparatus according to claim 1 wherein said pump outlet is in fluid communication with said well casing so as to supply pressurized gas to said well casing for impelling oil bearing liquid collected in said sump to said inlet opening in said string of tubing.

4. The apparatus according to claim 1 wherein said pump outlet is in fluid communication with an oxygen analyzer operable to disable said vacuum pump in the event that the fraction of oxygen in the vacuum pump discharge exceeds a prescribed level.

5. The apparatus according to claim 1 further comprising a remote gas source in fluid communication with said well casing to supply pressurized gas to said well casing for impelling oil bearing liquid collected in said sump to said inlet opening in said string of tubing.

6. The apparatus according to claim 4 further comprising a plurality of gas lift valves on said string of tubing for admitting pressurized gas from said remote gas source to the inside of said string of tubing.

7. An apparatus for fluid production from an oil bearing reservoir in the earth, comprising:

a tubular well casing extending into the earth, said well casing including a lower end disposed below the top of the oil bearing reservoir and an upper end remote therefrom, said well casing including a plurality of perforations therethrough communicating with the oil bearing reservoir so that oil bearing liquid flows into said well casing through said plurality of perforations, said well casing defining a sump therein at said lower end of said well casing for collecting oil bearing liquid therein;

a sealed wellhead on said upper end of said well casing;

a string of tubing depending from said wellhead in said well casing, said string of tubing including a lower end defining an inlet opening positioned in said sump, said string of tubing further including a plurality of downwardly projecting fins about said inlet opening; and, means for imposing a vacuum upon the inside of said string of tubing.

8. The apparatus according to claim 7 wherein said vacuum imposing means comprise a vacuum pump having a pump inlet and a pump outlet, said pump inlet communicating with the inside of said string of tubing so as to impose a vacuum on the oil bearing liquid collected in said sump and assist in drawing the oil bearing liquid collected in said sump into said inlet opening.

9. The apparatus according to claim 7 wherein said vacuum means comprises at least one gas ejector in fluid communication with said string of tubing.

10. The apparatus according to claim 8 wherein said pump outlet is in fluid communication with said well casing so as to supply pressurized gas to said well casing for impelling oil bearing liquid collected in said sump to said inlet opening in said string of tubing.

11. The apparatus according to claim 7 further comprising a remote gas source in fluid communication with said well casing to supply pressurized gas to said well casing for impelling oil bearing liquid collected in said sump to said inlet opening in said string of tubing.

12. The apparatus according to claim 11 further comprising a plurality of gas lift valves on said tubing for admitting pressurized gas from said remote gas source to said string of tubing.

13. A method for simultaneous liquid and gas production from a wellbore, comprising the steps of:

placing a string of tubing in the wellbore having an inlet opening partially submerged in the liquid in the wellbore;

evacuating liquid and gas from said string of tubing to establish subatmospheric pressure therein;

separating evacuated liquid from evacuated gas; compressing the evacuated gas; and, supplying to the wellbore the compressed gas to impel the liquid in the wellbore into said inlet opening in said string of tubing.

14. The method according to claim 13 further comprising the step of supplying to the wellbore pressurized gas from a remote source to assist in impelling liquid to said inlet opening in said string of tubing.

* * * * *